US005110018A

United States Patent [19]

Lothmann et al.

[11] Patent Number: 5,110,018

[45] Date of Patent: May 5, 1992

[54] CLOSING APPARATUS FOR THE BOTTOM POURING HOLE OF A CASTING LADLE

[75] Inventors: Josef Lothmann, Langerwehe; Jürgen Osborg-Schmitz, Hürtgenwald-Gey; Wolfgang Schönbrenner, Kreuzau, all of Fed. Rep. of Germany

[73] Assignee: Zimmermann & Jansen, Duren, Fed. Rep. of Germany

[21] Appl. No.: 661,421

[22] Filed: Feb. 26, 1991

[30] Foreign Application Priority Data

Feb. 26, 1990 [DE] Fed. Rep. of Germany ..... 4006064

[51] Int. Cl.[5] ..... B22D 41/34

[52] U.S. Cl. ..... 222/600; 266/236

[58] Field of Search ..... 222/591, 597, 600; 266/236

[56] References Cited

U.S. PATENT DOCUMENTS 4,591,080 5/1986 Yoshihara ..... 222/600

FOREIGN PATENT DOCUMENTS 1928400 1/1974 Fed. Rep. of Germany .
2704599 10/1979 Fed. Rep. of Germany .
2652732 1/1986 Fed. Rep. of Germany .

*Primary Examiner*—Scott Kastler
*Attorney, Agent, or Firm*—Lorusso & Loud

[57] ABSTRACT

A closing apparatus for the bottom pouring hole of a casting ladle, comprising a mounting plate mounted on the bottom of the ladle with a head plate resting against it, in which head plate a port is formed to pour out the melt, and further comprising a slide plate supported for pivoting movement about two axes and adapted to be pressed resiliently against the head plate. The slide plate is supported for reciprocating movement inside a housing. The housing is supported by a housing carrier structure, especially between the legs of carrier bracket for the housing, for pivoting movement about a first pivot axis, while the carrier bracket for the housing is supported by the mounting plate for pivoting about a second pivot axis. The first and second pivot axes extend parallel to each other and to the sealing face between the head and slide plates.

14 Claims, 7 Drawing Sheets

CLOSING APPARATUS FOR THE BOTTOM POURING HOLE OF A CASTING LADLE

FIELD OF INVENTION

The instant invention relates to a closing apparatus for the bottom pouring hole of a casting ladle.

PRIOR ART

A closing apparatus of that kind is known, for example, from the German Patent DE-A-26 52 732. There the slide plate is fixedly clamped, however, relative to the head plate and within the slidable metal frame in the closing position by two diametrically acting hook means. Instead of the aforementioned hooks hydraulically operable closing cylinders are proposed as well. These closing cylinders are provided to set an optimum sealing pressure between the closing and head plates, specifically in a way that the sealing operation is not substantially influenced by wear or deformation of the refractory plates. An automatic alignment of the slide plate relative to the head plate is not achieved in this configuration. Moreover, that structure is characterized by a comparatively high structural expenditure.

The aforementioned hook means allow all the less for an alignment of the slide plate relative to the head plate, with the result that due to soiling or uneven wear both the slide plate and the head plate are subjected to nonuniform loads with the consequence of a correspondingly inhomogenous wear of the slide and head plates.

Closing apparatus of that kind are also known, for example from DE-B-19 28 400. The known design is characterized in that the slide plate is supported at the bifurcated free end of a double link, pivotably supported at the bottom of the ladle, such that it is movable universally with respect to the sealing face, with one of the Cardanic axes coinciding with the double link axis located at the bifurcated end and extending in horizontal direction, and the second Cardanic axis being defined by the vertical pivot axis of the slide member. This Cardanic suspension permits the slide plate to carry out pivoting motions about two axes at right angles to each other.

That is intended to assure a more uniform pressure loading of all points of engagement of the slide plate with the sealing surface of the pouring ladle. The forced parallelism between the slide plate and the sealing face and the uniform pressure loading of the selaing face, moreover, make sure that the cooperating surfaces are sealed reliably and worn uniformly in the opening and closing of the stopper. The design according to DE-B-19 28 400, however, is such that the above mentioned double link itself is not pivotable about a horizontal axis and consequently the mounting and demounting of the slide plate is rather expensive. Quick opening of the slide plate for the above mentioned purpose is not possible. In this respect there is not a hint of any appropriate measure and, of course, that is due also to the fact that actually the known design relates to a kind of rotary slide type closure.

It is known from DE-B-27 04 599 to provide a pivotable kind of support for the slide plate, including the respective frame and housing, at the mounting plate which is mounted on the bottom of the ladle so as to permit the assembly and disassembly of the slide plate. With this kind of embodiment, however, the parallel alignment of the slide and head plates with respect to each other presents a design problem which was solved by the toggle joint structure shown in FIG. 1 of DE-B-27 04 599. That structure still is being used successfully in practice. Yet the known toggle joint structure is extremely expensive and also rather complicated to handle.

SUMMARY OF THE INVENTION

It is the object of the invention, starting from the state of the art recited, to provide a slide member closing apparatus which is both easy to open and close and also guarantees automatic alignment of the slide plate so that uniform pressure will be exerted on the sealing face, thereby establishing a reliable seal and uniform wear of the interacting surfaces of the slide and head plates.

The double pivot support of the slide plate permits the slide type closure member to be opened and closed like a door or window. At the same time it is assured that any deviations from the parallel alignment between the slide and head plates are excluded. The forced parallelism of the slide and head plates warrants that the pressure loading of the sealing faces will be uniform so that a reliable seal is obtained and the cooperating surfaces of the slide and head plates become worn uniformly by the opening and closing of the closure.

The pivot axes are of particular significance according to which the pivot axes of the slide plate housing and of the housing carrier structure each extend parallel to the adjusting direction of the slide plate. With this embodiment the slide member is pivotable about a longitudinal edge which is much longer than the cross edge so that not too much space is required for opening the gate-type closure.

Likewise particularly interesting is the closing means which provides for an hydraulically or hydropneumatically operable piston and cylinder unit to close the apparatus. This unit is adapted to move the slide plate into operating position, overcoming a predetermined sealing bias between the slide and head plates. Once in this position, the slide plate is held by a retainer hook or the like. The piston and cylinder unit mentioned thus presses the slide plate against the head plate under slightly increased pressure, doing so against the effect of the contact pressure springs which act on the slide plate and determine the sealing bias between the slide and head plates, whereby the mechanical locking by the retainer hook mentioned becomes possible. Following this mechanical locking, the piston and cylinder unit is removed again, if desired, by simply swinging it into an inoperative position. The piston and cylinder unit mentioned above, preferably, is coupled to a device for measuring and/or adjusting the pressure so as to determine and/or set the closing and opening pressure. That makes it possible, at the same time, to determine any excessive wear at the slide plate and/or the head plate. Furthermore, the device in question makes it possible to find out whether, upon repair, slide plates have been ground down too thin, whether the closing mechanism is worn out, whether the slide plate springs are defect, the spring cages positioned too low, or a similar defect exists, all of which would affect the contact pressure required for the slide plate.

Finally, special reference should be made to the piston and cylinder unit, the axis of which lies in a plane parallel to the sealing face between the slide plate and the head plate for which protection is claimed also independently of the above mentioned design, distinguishing this embodiment from the structure disclosed in DE-A-26 03 003. This known structure requires a lot force to handle because the rather great weight of the piston and cylinder unit associated with the slide plate makes it difficult to suspend it from the corresponding holding lugs and couple it to the slide plate or to an intermediate piece joined with the same. All that is needed to remedies or ease the situation is to put down the piston and cylinder unit with its two diametrically disposed radial pins on the two associated ramps and then push it over the ramps into corresponding recesses. That can be accomplished by a single person, whereas the known structure always requires two people, one to hold the piston and cylinder unit and another one to insert the radial bolts or pins into the respective pivot recesses.

BRIEF DESCRIPTION OF THE DRAWINGS

The invention will be described further, by way of example, with reference to the accompanying drawings, in which:

FIG. 1 illustrates a closing apparatus for the bottom pouring hole of a casting ladle. It comprises a mounting plate 10 secured to the bottom of the ladle and a head plate 13 which rests from below against the mounting plate, as indicated by discontinuous lines in FIG. 1, and in which a port 11 is formed through which the metal melt is poured out. In operative position, a slide plate 12 abuts against the lower side of the head plate 13, the slide plate likewise being formed with a port 14 for passage of the melt. The slide plate 12 which likewise is shown only by discontinuous lines in FIG. 1 is inserted in a frame 15 arranged in a housing 16 so as to be movable back and forth in a plane perpendicular to the central axis of the melt outlet ports 11 and 14, respectively. A plurality of contact pressure springs, not shown specifically in FIG. 1, are arranged in per se known manner between the frame 15 and the slide plate 12. At their lower ends they rest on the frame 15, and they exert pressure on the slide plate 12 in upward direction or toward the head plate 13. The slide plate 12, together with the frame 15 and the housing 16, is supported for pivoting motion about a first pivot axis 18 between the two legs of a U-shaped carrier bracket 17 for the housing (see double arrow 19 in FIG. 1). The carrier bracket 17 in turn is supported at the mounting plate 10 for pivoting motion about a second pivot axis 20 which extends through the two ends of the legs of the carrier bracket. As may be seen in FIG. 1, the first and second pivot axes 18 and 20 extend parallel to each other and to the mounting plate 10 or sealing face between the head and slide plates. The double pivot axis type of support of the slide plate described and illustrated in detail in FIG. 1 excludes deviations from the parallel alignment of the corresponding surfaces of the head and slide plates in operative position, i.e. when the casting ladle is closed. In closing the apparatus, the slide plate 12 adjusts itself in parallel with the head plate, doing so automatically. As a result, the above mentioned tensioning springs exert uniform pressure on the slide plate 12. Accordingly, a permanent, reliable seal is obtained between the slide plate and the head plate. And the wear of the corresponding surfaces of slide and head plates is uniform and thus the optimum.

In the embodiment shown, the pivot axes 18, 20 each extend approximately parallel to the direction of displacement of the slide plate 12. Preferably the first pivot axis 18 is approximately aligned with the longitudinal central axis of the slide running in the direction of displacement of the slide plate 12.

Figure 4:
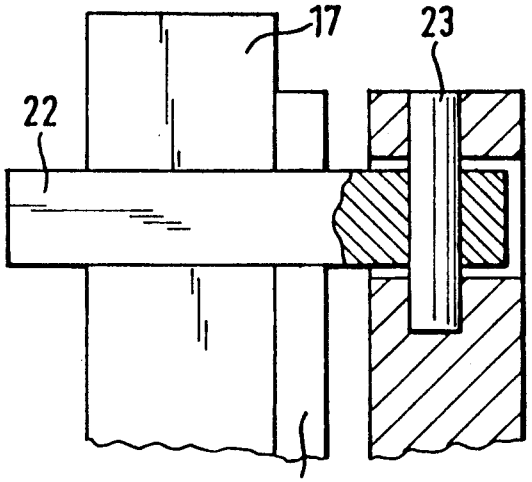
FIG. 4 is a lateral view, in the direction of arrow "A", of the locking shown in FIG. 3.
Figure 3:
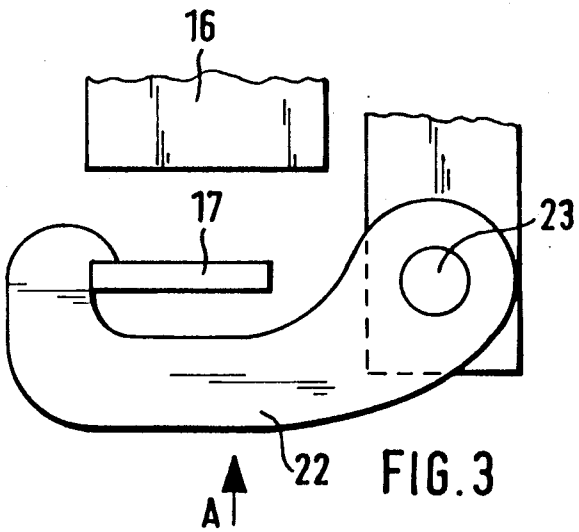
FIG. 3 is a top plan view of the locking of the closing apparatus shown in FIG. 1.
Figure 2:
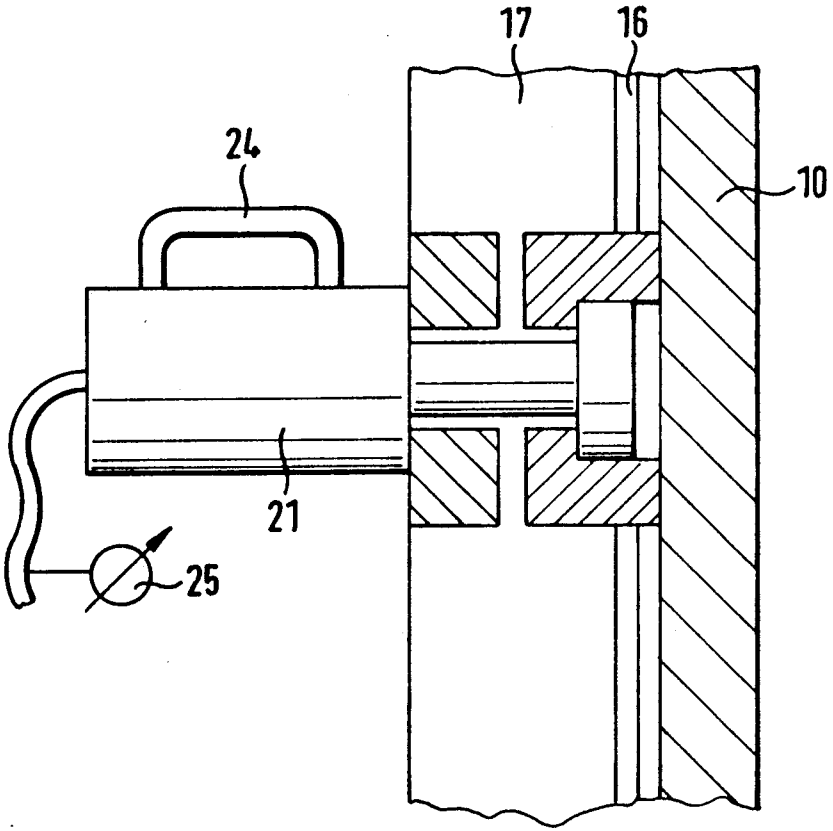
FIG. 2 is a diagrammatic cross sectional view of a closing aid of the apparatus.

The slide plate 12, including the frame 15 is adapted to be moved into operative position by a closing means in the form of an hydraulically or hydropneumatically operable piston and cylinder unit 21 (cf. FIG. 2) engaging the pivotably supported carrier bracket 17, on the one hand, and the mounting plate 10, on the other hand, while overcoming the above mentioned sealing bias between the slide plate and the head plate caused by contact pressure springs which are disposed between the slide plate and the slide plate frame. Once in the operative position mentioned, the slide plate is retained by a retainer hook 22 pivotably supported at the mounting plate 10, as shown in FIGS. 3 and 4. Preferably, there are two retainer hooks 22, one at either side of the closing means 21, the pivot axes of the retainer hooks likewise extending parallel to the two above mentioned pivot axes 18,20. In FIGS. 3 and 4 the pivot axis of the retainer hook 2 is marked by reference numeral 23. The closing means or piston and cylinder unit 21 presses the slide plate against the head plate, counteracting the associated biasing springs and pressing the slide plate until the retainer hooks 22 can become engaged behind the carrier bracket 17, as shown in FIG. 3. Subsequently, the piston and cylinder unit 21 is released and removed again. Thus the piston and cylinder unit 21 merely serves for closing and also for opening of the apparatus specified, such as for purposes of assembling or disassembling or for exchanging the slide plate and/or the head plate. To this end, the casting ladle is moved into a position in which the pivot axes 18,20 are approximately vertical. In this manner only little space is needed for opening the slide assembly. The carrier bracket 17, including the housing 16 and the slide plate 12, is opened like a relatively narrow door.

The closing means 21 described above which is provided with a handle 24 also can be coupled with a pressure measuring and/or adjusting device to determine and/or adjust the closing or opening pressure. The device mentioned is indicated by reference numeral 25 in FIG. 2. It can be determined by this device whether or not the contact pressure between the slide and head plates still is sufficient. Furthermore, it can be determined whether or not the springs are defect that bias the slide plate into operating position. When inserting a repaired slide plate, the pressure measuring and/or adjusting device 25 also may be used to determine whether the slide plates were ground too thin during repair so that sufficient contact pressure between the slide plate and the head plate is not warranted in operation. Furthermore, it can be found out in this manner whether the slide mechanism is worn out or the biasing spring cages are seated too low. In this respect the closing means specified, together with the pressure measuring and/or adjusting device 25, presents an extremely useful aid.

The slide plate 12 is driven, i.e. moved back and forth in conventional manner by an hydraulically operable piston and cylinder unit so as to adjust the desired degree of opening of the pouring port of the casting ladle. With the embodiment according to FIG. 1, the piston and cylinder unit is connected to a connecting cylinder 26 through which passes a tubular or rod-like intermediate piece 27 which is reciprocable together with the slide plate. The free end of the piston rod of the above mentioned piston and cylinder unit is coupled to this intermediate piece.

Figure 5:
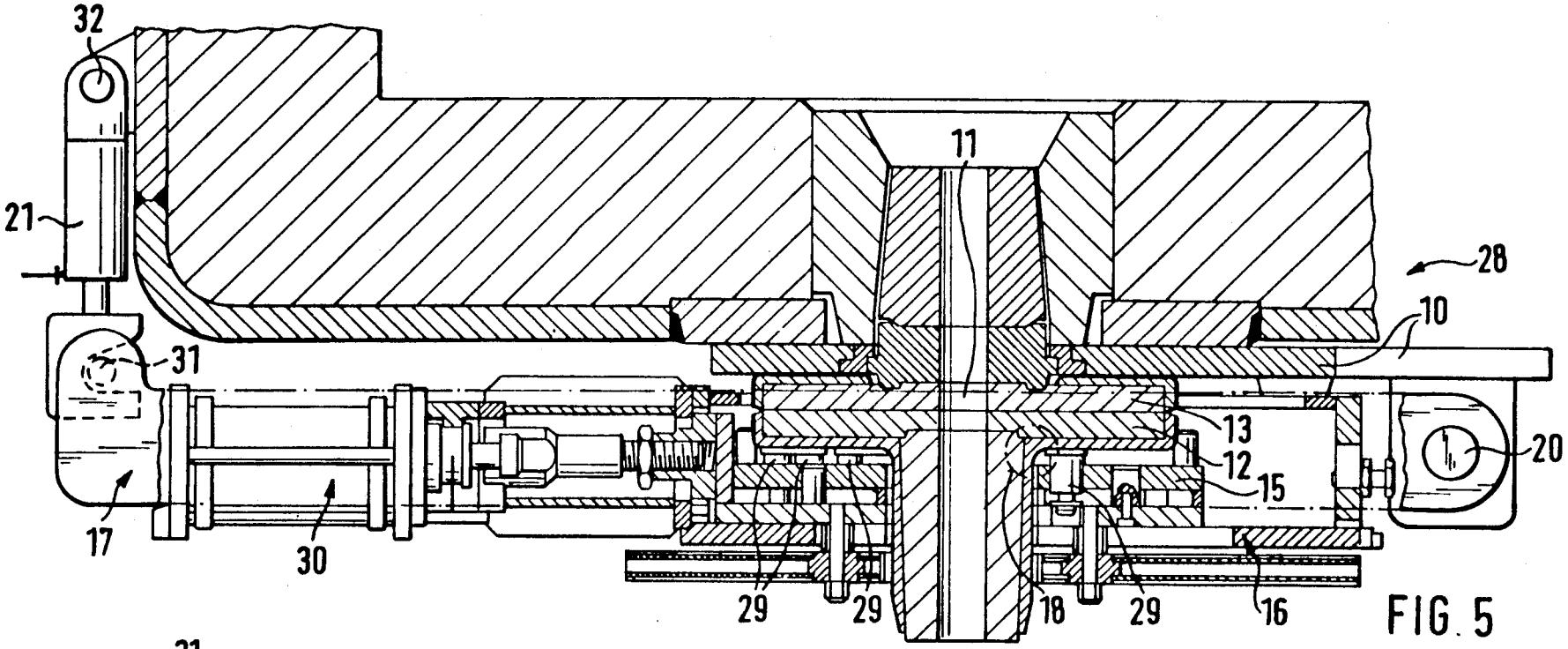
FIG. 5 is a view, partly in section and partly in diagrammatic side elevation, of a modified embodiment of the closing apparatus according to the invention.
Figure 6:
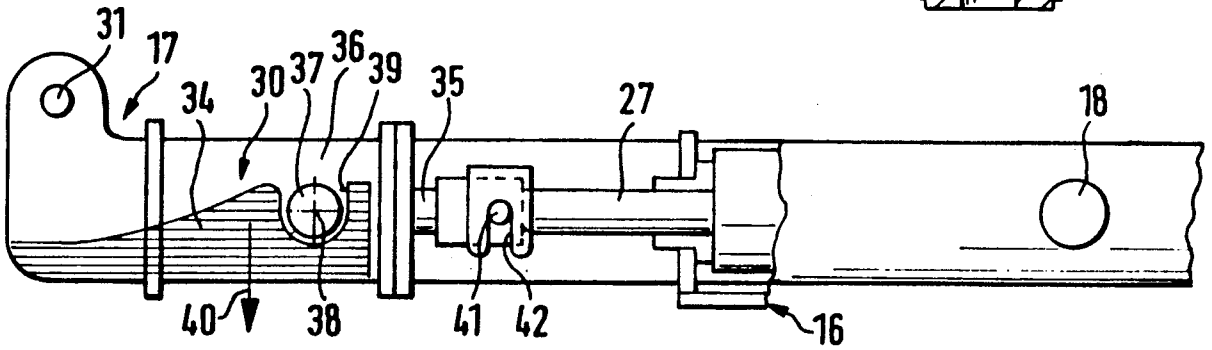
FIG. 6 is a diagrammatic side elevation of part of the apparatus shown in FIG. 5.
Figure 7:
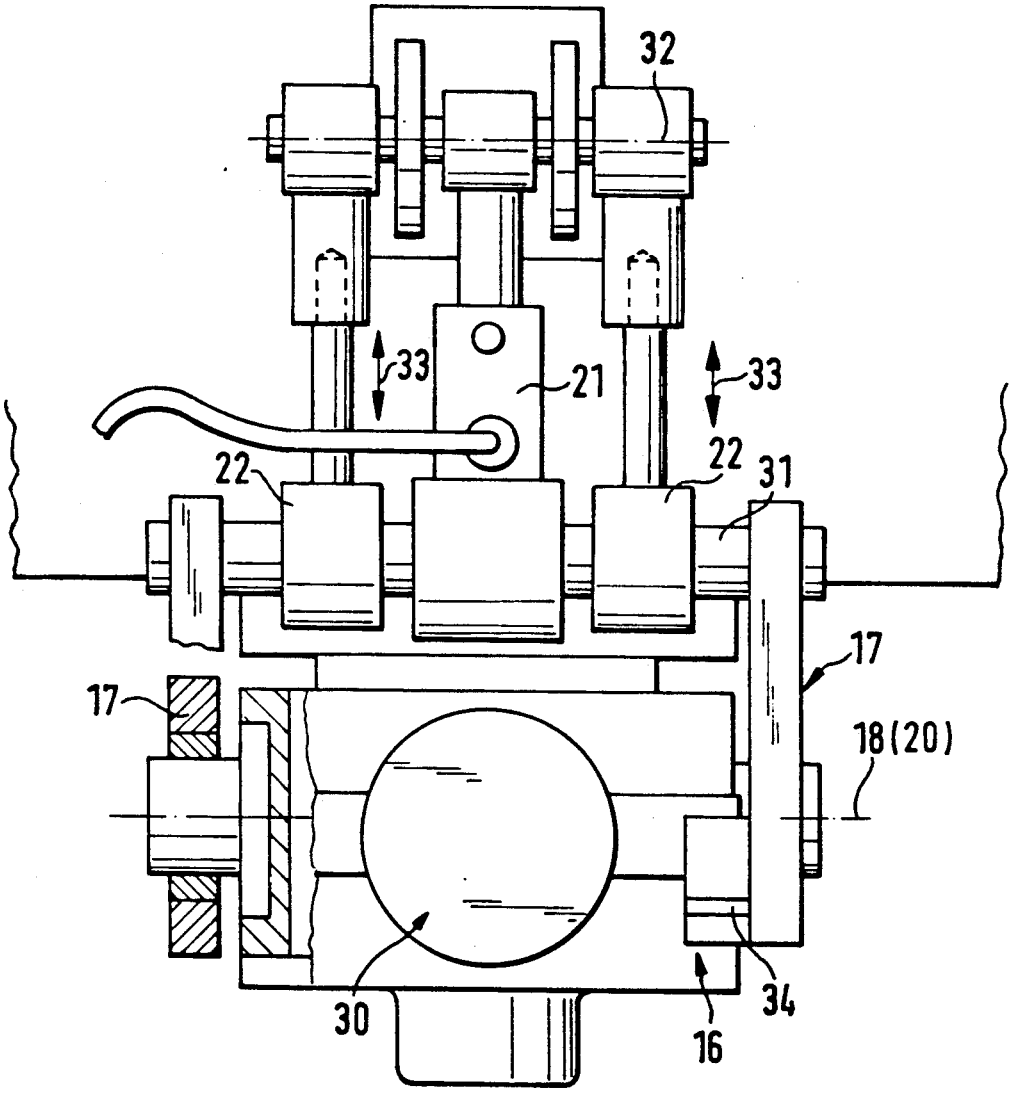
FIG. 7 is a rear view of the apparatus shown in FIGS. 5 and 6, showing the closing and biasing cylinder and the introducing ramps for the piston and cylinder unit coordinated with the slide plate.

FIGS. 5 to 7 show a modified embodiment of a closing apparatus according to the invention. With this apparatus, too, a mounting plate 10 is fixed to the bottom 28 of the casting ladle, and a head plate 13 rests against the mounting plate from below. The head plate has a port 11 for passage of the melt to be poured out. The slide plate 12 with its port 14 abuts against the lower side of the head plate 13. The slide plate 12 is inserted in a frame 15 arranged for displacement in a housing 16 from left to right and vice versa in FIG. 5. A plurality of contact pressure springs 29 are arranged between the frame 15 and the slide plate 12. At their lower ends, they rest on the frame !5, and they exert contact pressure in upward direction on the slide plate 12.

In a manner similar to that of the embodiment shown in FIGS. 1 to 4, the housing 16, including the slide plate 12 and the slide plate frame 15, is supported between the two legs of a carrier bracket 17 for the housing so as to be pivotable about a first pivot axis 18, while the carrier bracket 17 is supported for pivoting motion about a second pivot axis 20. The first and second pivot axes extend in parallel with each other and also parallel to the mounting plate 10 or sealing face between the slide and head plates. In this embodiment, the pivot axes 18,20 further each extend vertically with respect to the direction of displacement of the slide plate as given by the drive means in the form of an hydraulically operable piston and cylinder unit 30 associated with the slide plate. The opening and closing of the apparatus specified is effected, in the case of this embodiment, by an hydraulically or hydropneumatically operable piston and cylinder unit 21. The piston rod of this unit can be hooked up at the web 31 of the carrier bracket 17 for the housing. The diametrical end of the piston and cylinder unit 21, i.e. the cylinder thereof is pivoted at the casting ladle (pivot bearing 32). Durable closing is realized in a manner similar to the embodiment described above, namely purely mechanically by retainer hooks 22 engaging the above mentioned web 31 of the carrier bracket 17 for the housing, as shown in FIG. 7. The length of the retainer hooks 22 is adjustable, as indicated in FIG. 7 by the double arrows 33. In this manner the spring bias for the slide plate 12 in continuous operation position is adjustable. The retainer hooks 22 also are supported at the casting ladle for pivoting motion about the above mentioned pivot bearing axis 32 for the piston and cylinder unit 21, this being at the sidewall of the casting ladle facing the slide plate drive (see FIG. 5).

As already mentioned, the slide plate 12 is shifted by means of a piston and cylinder unit 30 the axis of which, in operative position, lies in a plane substantially parallel to the sealing face of the slide plate. Members of a coupling each are associated with the piston rod 35 and the movable slide portion or an intermediate piece 27 connected to the same, on the one hand, and the cylinder 36 and the carrier bracket 17, on the other hand, such that the coupling members of the connection between the movable slide portion and the piston rod 35 are moved into engagement by pivoting movement of the piston and cylinder unit 30 in a substantially vertical plane (being the plane of the drawing of FIGS. 5 and 6) and are held in engagement by a tilting moment which is effective in the plane of the pivoting movement. To be able to carry out the pivoting movement mentioned of the piston and cylinder unit 30, the cylinder 36 comprises two diametrically positioned radial bolts 37 which, forming the pivot axis 38 of the piston and cylinder unit 30, correspond to two upwardly open and mutually aligned recesses 39 at two spaced apart holding lugs or —as is the case here—at the two legs of the carrier bracket 17 for the housing. It is particularly significant with the embodiment illustrated that the two recesses 39 each are part of a ramp 34, each ramp 34 preceding the respective recess 39. In the embodiment shown, the ramps 34 each are positioned at the inside of those ends which face the web of both legs of the carrier bracket 17 for the housing. As shown in FIG. 6, the ramps each are slightly curved concavely, when looked at from the top, i.e. from the casting ladle. Moreover, the transition between each ramp 34 and the associated recess 39 is rounded so as to facilitate introducing the radial bolts 38 formed at the cylinder 36 of the piston and cylinder unit 30 into the two recesses 39. To obtain the tilting moment described above, the center of gravity of the piston and cylinder unit 30 lies between the recesses 39 and the web 31 of the carrier bracket 17 for the housing. The above mentioned coupling members consist of two diametrically disposed radial bolts 41 at the free end of the piston rod 35 of the piston and cylinder unit 30, on the one hand, and corresponding ones having downwardly open recesses 42 at the end of the intermediate piece 27 facing the piston and cylinder unit 30, the intermediate piece being functionally connected with the slide plate 12. Both the radial bolts 37 at the cylinder 36 and the radial bolts 41 at the free end of the piston rod 38 of the piston and cylinder unit 30 all extend parallel to the sealing face between the slide and head plates, preferably at the level of the longitudinal central axis of the piston and cylinder unit 30, as may be taken from FIG. 6. The two pivot axes 18,20 preferably also lie in the same plane.

The ramps 34 mentioned above facilitate the assembly and disassembly of the piston and cylinder unit 30 or the coupling and uncoupling of this unit to and from the movable slide portion or intermediate piece 27 which is linked to the slide portion. When the piston and cylinder unit 30 is uncoupled and pulled out of the recesses 39, it need not be feared that the piston and cylinder unit 30 might drop on the floor, not even if this job is done by a single person. The piston and cylinder unit 30 continues to be supported by the radial bolts 37 on both ramps 34. And vice versa, the two ramps 34 also facilitate the coupling. The piston and cylinder unit is placed with its two radial bolts 37 on the free ends of the ramps 34. Then the piston and cylinder unit 30 is pushed over the two ramps to the two recesses 39 at the inside ends of the ramps 34 until the radial bolts 37 disposed at the cylinder 36 of the piston and cylinder unit 30 come to rest in the recesses 39. Thereupon the piston rod 35 is coupled in conventional manner to the intermediate piece 27, such as specified for example in DE-A-26 03 003. The effective ramp surface need not necessarily be arched concavely; a rectilinear ramp surface can be used as well. Preferably however, the free end, the left end in FIG. 6, of the ramp surfaces each extends approximately parallel to the direction of movement of the slide or approximately parallel to the sealing face between the slide and head plates. That makes sure that the piston and cylinder unit 30 cannot accidentally slip off and fall down on the floor, posing a risk of injury to the operator, when it is being placed on the free ends of the ramps 34. To reduce that risk still further, it may be of advantage to form a small, upstanding projection at the free end of each ramp 34. The piston and cylinder unit 30 then must be lifted across them for mounting and demounting.

For easier assembly and disassembly of the piston and cylinder unit 30, furthermore the radial bolts 37 at the cylinder 36 may be embodied by runner rolls.

The ramps in question are advantageous also for conventional slide type closures. Those may be retrofit accordingly. Referring to the above mentioned DE-A-26 03 003, the ramps mentioned above would have to be formed at the inner sides of the holding lugs for the piston and cylinder unit. As an alternative, the holding lugs themselves could be designed like ramps.

Figure 1:
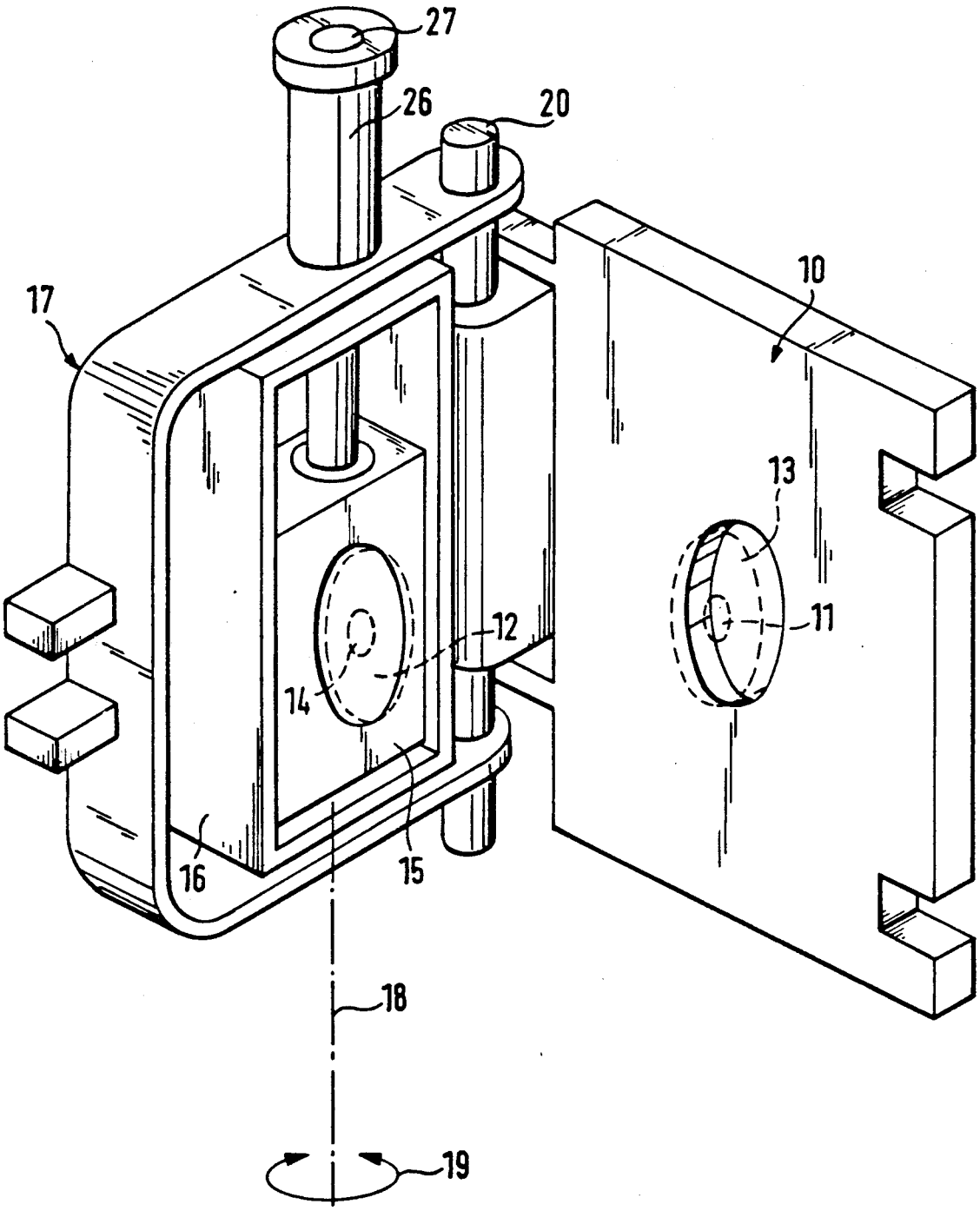
FIG. 1 is a diagrammatic perspective view of a closing apparatus designed according to the invention.
Figure 8:
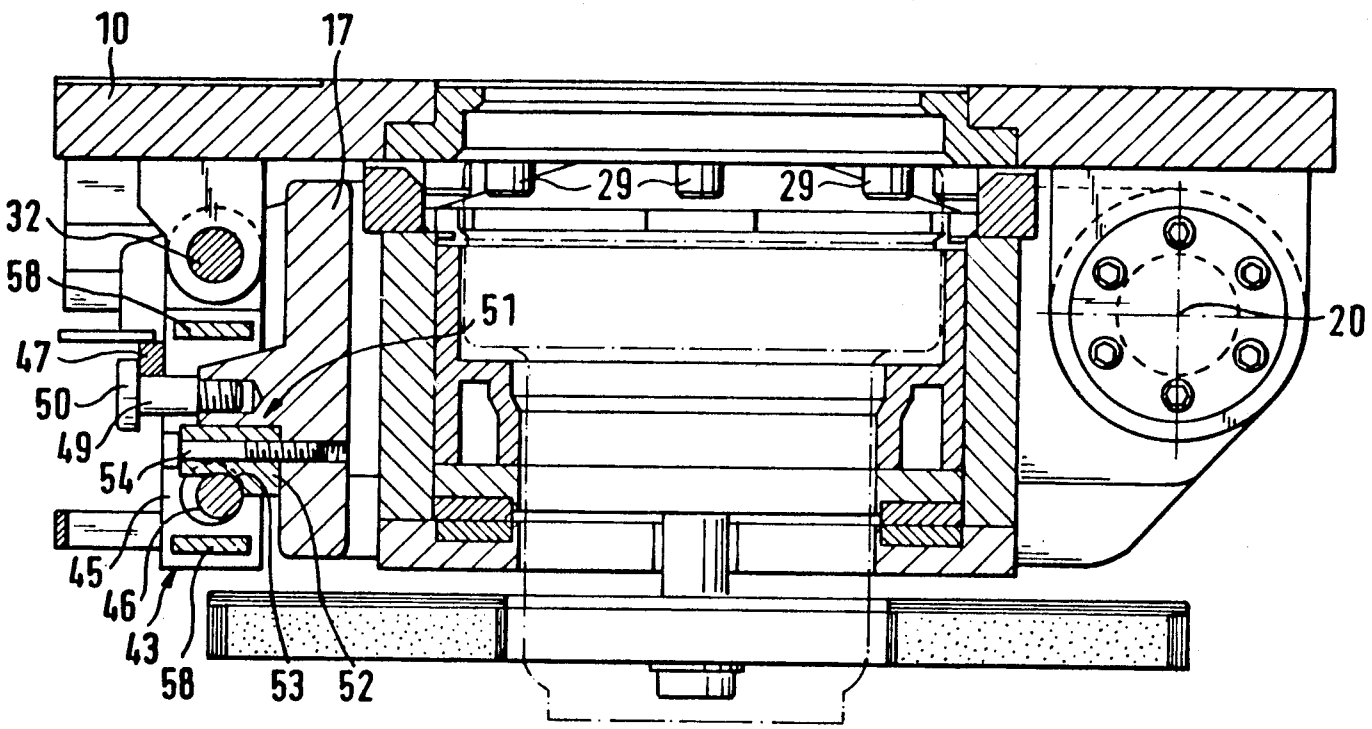
FIG. 8 is a detailed cross sectional view of a closing apparatus as shown in FIG. 1, presenting a preferred embodiment of a closing means.

FIG. 8 is a detailed cross sectional view of the closing apparatus according to FIG. 1. Those parts already explained with reference to FIG. 1 are given the same reference numerals in FIG. 8. A preferred means for closing and retaining the carrier bracket 17 for the housing will now be explained with reference to FIG. 8 and FIGS. 9 and 10. The holding means in question is marked by reference numeral 43. It comprises two holding lugs 44,45 which are axially spaced apart and pivotably supported at the mounting plate 10 (cf. especially FIGS. 9 and 10). Their free ends offer pivotable support to an eccentric 46 which extends transversely and, when in operative position, engages behind a nose 51 projecting from the carrier bracket 17 for the housing. Preferably, two spaced apart holding means 43 of the kind described are associated with the longitudinal web of the carrier bracket 17 for the housing. The pivot axis of the holding lugs 44,45 or holding means 43 is marked by reference numeral 32. Exchangeably mounted members 52 are associated with the respective noses 51 formed at the longitudinal web of the carrier bracket 17 for the housing. Each member 52 has a support surface 53 for the eccentric 46. As shown in FIG. 8, the support surface 53 is adapted to the circular cylindrical peripheral surface of the eccenter and is arranged slightly deeper. Therefore, in closing the apparatus, the eccentric 46 becomes locked in the support surface 53 while overcoming bias caused by the contact pressure springs 29 which act on the slide plate 12. FIG. 8 shows the eccentric 46 in this position. The sealing bias between the slide plate and the head plate can be adjusted or readjusted by means of this eccentric 46. Such readjustment helps to compensate any possible wear within the slide. When there are two or more of the holding means 43 of the kind described above, it is a matter of course that the eccentrics 46 each must be in the same position in order to warrant uniform contact pressure of the slide plate across its full length and width.

The support member 52 mentioned above is fixed by screw bolts 54 to the longitudinal web of the carrier bracket 17 for the housing.

The two holding lugs are interconnected rigidly according to FIG. 8 by diametrically disposed crossties 58.

Figure 9:
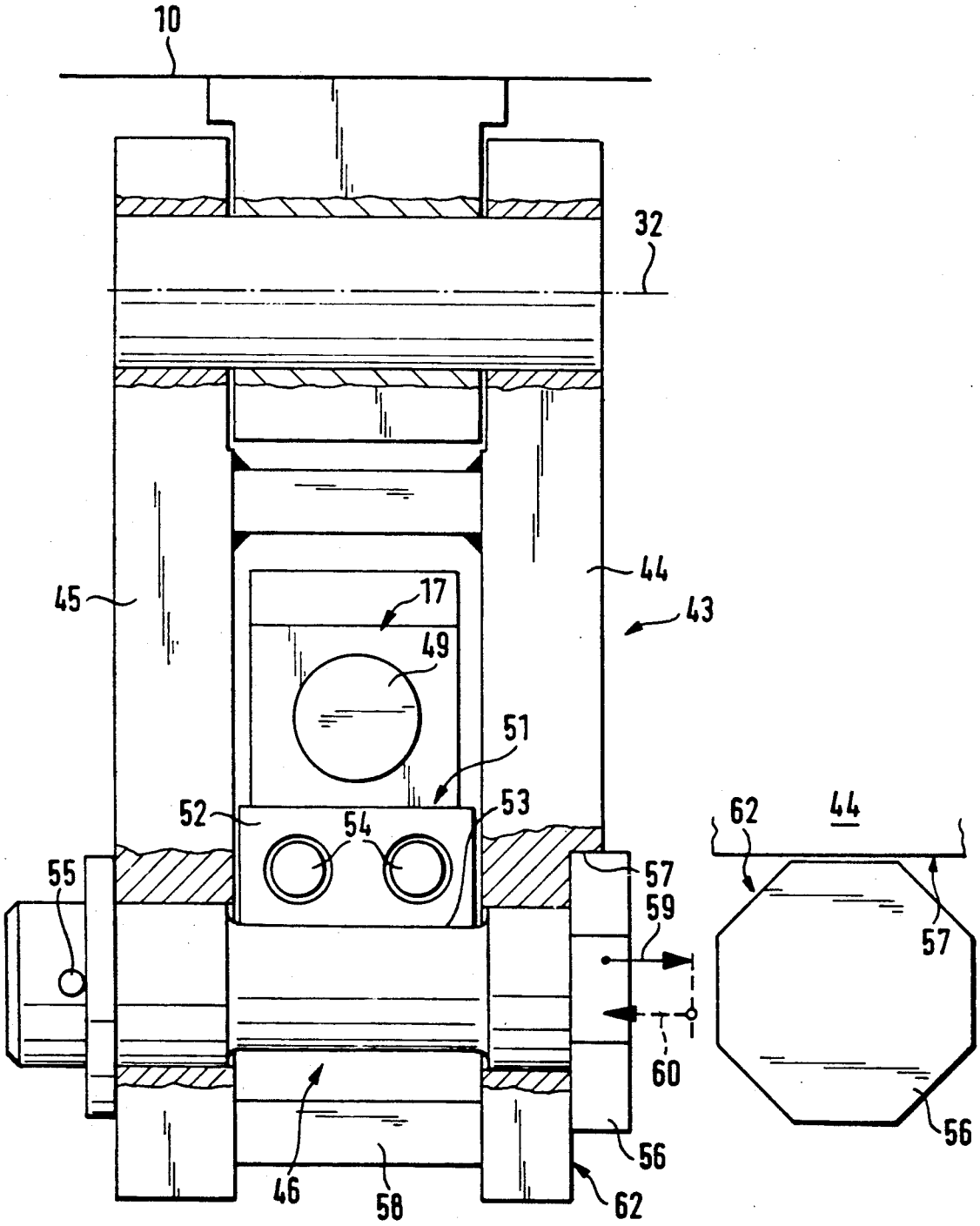
FIGS. 9 and 10 show the closing means of FIG. 8 on an enlarged scale in section and elevation, respectively.

According to FIG. 9, the rotably supported eccentric has an octogonal collar 56 at one end and a transverse split pin 55 at the opposite end. The split pin 55 first must be removed to be able to adjust or rotate the eccentric. Thereupon the eccentric can be displaced in the direction marked 59, i.e. to the right in FIG. 9, until the octogonal collar comes free of a complementary abutment surface 57 within a lateral recess 62 at the outside of the holding lug 44 associated with the collar 56. Subsequently, the eccentric 46 can be turned to the right or left, with corresponding positional change of the contact surface of the eccentric 46 which cooperates with the nose 51 or support surface 63 of the support member 52. Thereafter the eccentric 46 is pushed back in the direction of arrow 60 and secured in position by means of the split pin 55. The octogonal design of the collar 56 permits the eccentric to be fastened in eight different rotary positions.

Figure 10:
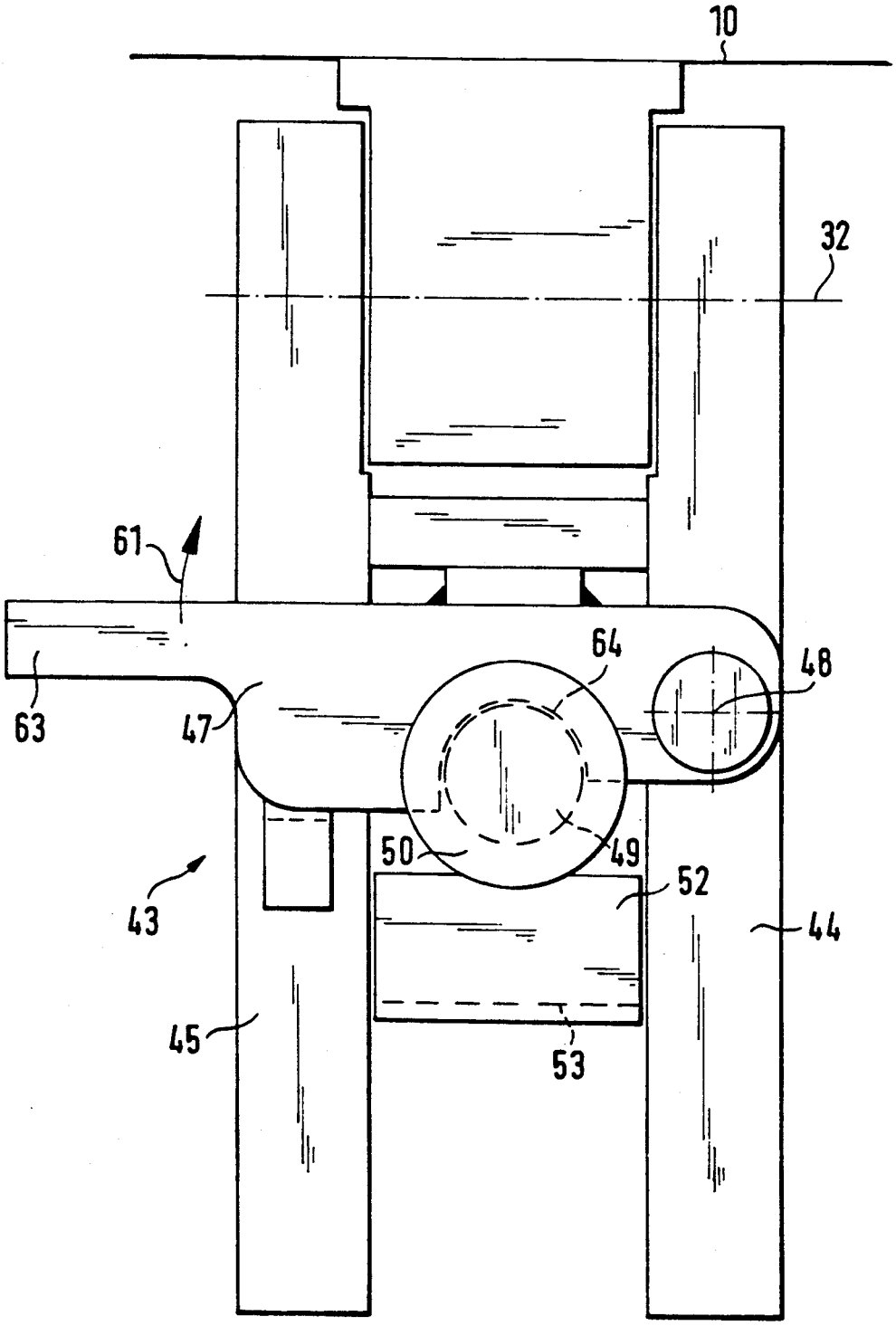

A safety catch is pivotably supported at the side of the holding lugs 44,45 remote from the slide, this being at the holding lug 44 in the embodiment as shown in FIG. 10. The corresponding pivot support of the safety catch 47 is marked by reference numeral 48. In operating position, the safety catch 47 cooperates with a safety bolt 49 fixed to the carrier bracket 17 for the housing and passes between the two holding lugs 44,45 such that the holding means 43 specified cannot be pivoted into carrier bracket release position unless the safety catch 47 is raised. In the embodiment shown, the safety catch 49 is fastened at the free face end of the nose 51 and it has a radially projecting collar 50 at the free end.

When the apparatus is in operating position, i.e. closed, the safety catch 47 engages between the holding lugs 44,45, on the one hand, and the collar 50 of the safety bolt 49, on the other hand, as may be gathered both from FIGS. 8 and 10. The safety catch 47 is provided with a handle 63 at the end opposite the pivot bearing 48. The pivoting of the safety catch 47 into the position of release of the carrier bracket is indicated by arrow 61 in FIG. 10. The safety catch 47 reliably prevents any unintended opening of the closing apparatus. In the embodiment shown, the safety catch 47 has a recess 64 approximately of semicircular shape which corresponds to the upper half of the safety bolt 49.

All the features disclosed in the application documents are claimed as essential to the invention to the extent that they are novel in view of the state of the art, either individually or in combination.

What is claimed is:

1. A closing apparatus for a bottom pouring hole of a casting ladle, comprising a mounting plate mounted on the bottom of the ladle with a head plate resting against the mounting plate, in which head plate a port is formed to pour out melt, and further comprising a slide plate supported for pivoting movement about two axes and adapted to be pressed resiliently against the head plate, wherein the slide plate is supported for reciprocating movement inside a housing and the housing is supported by a housing carrier means, for pivoting movement about a first pivot axis, while the housing carrier means is supported by the mounting plate for pivoting about a second pivot axis, with the first and second pivot axes extending parallel to each other and to the sealing face between the head and slide plates, wherein said housing support means comprises a U-shaped carrier bracket, said slide plate between the two legs of the carrier bracket, a frame which the slide plate rest against, and said housing for pivotal movement, defining said first pivot axis, with said carrier bracket being adapted to be moved into an operating position by a closing means engaging a web at said bracket, on one hand, and said mounting plate, on the other hand, in which position said bracket is then retained by a retainer hook or similar mechanical holding means.

2. The apparatus as claimed in claim 1, wherein the slide plate has a direction of adjustment and a center axis, and wherein the pivot axes each extend in parallel with the direction of adjustment of the slide plate.

3. The apparatus as claimed in claim 2, wherein the first pivot axis is approximately aligned with the center axis of the slide plate extending parallel to the direction of adjustment of the slide plate.

4. The apparatus as claimed in claim 1, wherein, the slide plate is adapted to be moved into operating position by the closing means, wherein the closing means can be an hydraulically or hydropneumatically operable piston and cylinder unit by means of which the carrier bracket can be moved into the operating position, while overcoming a sealing bias between the slide plate and the head plate caused by the slide plate being resiliently pressed against the heat plate, the slide plate, when in operating position, being retained by the retainer hook or similar mechanical means.

5. The apparatus as claimed in claim 4, wherein the closing means is coupled to a pressure measuring or adjusting device to determine or adjust the closing or opening pressure.

6. The apparatus, as claimed in claim 1, comprising a piston and cylinder unit the axis of which, in operative position, lies in a plane substantially parallel to a sealing face between the slide plate and the head plate, with members of a respective coupling means each being associated with a piston rod and a movable slide portion or an intermediate piece connected to the same, on the one hand, and a cylinder and a fixed slide portion, on the other hand, so that the coupling members of the link between the piston rod and the movable slide portion are moved into engagement by pivoting motion of the piston and cylinder unit in a substantially vertical plane and are kept in engagement by a tilting moment effective in the plane of the pivoting motion, the cylinder comprising two diametrically arranged radial cylinder bolts which, forming the pivot axis of the piston and cylinder unit, correspond to two upwardly open and mutually aligned recesses at two spaced apart holding lugs for the piston and cylinder unit, wherein a mounting ramp each for the piston and cylinder unit is arranged upstream of the two recesses.

7. The apparatus as claimed in claim 6, wherein the mounting ramps each are curved slightly concavely as seen from the top, i.e. from the casting ladle, and in that the transition between the ramp and the associated recess is rounded.

8. The apparatus as claimed in claim 6 wherein the two holding lugs including the ramps are formed at the carrier bracket for the slide plate housing or the ramps are arranged at the two legs of the carrier bracket for the housing, specifically at the inner sides each, depending on the position of the first and second pivot axes.

9. The apparatus as claimed in claim 4 wherein the holding means comprises a setting means for adjusting or readjusting the sealing bias between the slide plate and the head plate.

10. The apparatus as claimed in claim 9, wherein the holding means is constituted by two holding lugs which are pivotably supported at the mounting plate and the free ends of which pivotably support an eccentric extending transversely and engaging behind a nose which is arranged to project from the carrier bracket for the housing, when the apparatus is in operating position, wherein the eccentric being the means for adjustment or readjustment of the sealing bias beteen the slide and head plates.

11. The apparatus as claimed in claim 10, wherein a safety catch is pivotably supported at the holding means and, when in operative position, cooperates with a safety bolt which is fixed to the carrier bracket for the housing and extends between the two holding lugs so that the holding means cannot be swung into carrier bracket release position unless the safety catch is raised.

12. The apparatus as claimed in claim 11, wherein the safety bolt includes a radially projecting collar, and in that the safety catch engages between the holding lugs and the collar of the safety bolt when the apparatus is in operating position.

13. The apparatus as claimed in claim 10 wherein the projecting nose at the carrier bracket for the housing comprises an exchangeably mounted member having a support surface for the eccentric of the holding means.

14. The apparatus as claimed in claim 13, wherein the support surface is adapted to the circumferential surface of the eccentric and arranged slightly depressed so that, on closing of the apparatus, the eccentric will snap into engagement with the support surface, overcoming bias caused by contact pressure springs which act on the slide plate.

* * * * *